US007473283B2

(12) United States Patent
Tuli et al.

(10) Patent No.: US 7,473,283 B2
(45) Date of Patent: Jan. 6, 2009

(54) FUEL ADDITIVE COMPOSITION FOR STABILISING BLENDS OF ETHANOL AND A HYDROCARBON

(75) Inventors: Deepak Kumar Tuli, Faridabad (IN); Rakesh Sarin, Faridabad (IN); Krishan Kumar Swami, Faridabad (IN); Shanti Parkash, Faridabad (IN); Rajeev Ranjan, Faridabad (IN); Niranjan Raghunath Raje, New Delhi (IN); Ram Prakash Verma, Faridabad (IN); Akhilesh Kumar Bhatnagar, Faridabad (IN)

(73) Assignee: Indian Oil Corporation, Limited, Maharashtra (IN)

( * ) Notice: Subject to any disclaimer, the term of this patent is extended or adjusted under 35 U.S.C. 154(b) by 728 days.

(21) Appl. No.: 10/505,295

(22) PCT Filed: Jun. 26, 2002

(86) PCT No.: PCT/IN02/00140

§ 371 (c)(1),
(2), (4) Date: Mar. 9, 2005

(87) PCT Pub. No.: WO2004/003114

PCT Pub. Date: Jan. 8, 2004

(65) Prior Publication Data

US 2005/0160661 A1 Jul. 28, 2005

(51) Int. Cl.
*C10L 1/00* (2006.01)

(52) U.S. Cl. ..... 44/307

(58) Field of Classification Search ..... 44/307
See application file for complete search history.

(56) References Cited

U.S. PATENT DOCUMENTS

| | | | | |
|---|---|---|---|---|
| 4,384,872 | A | 5/1983 | Kester et al. | 44/56 |
| 4,410,334 | A | 10/1983 | Parkinson | |
| 4,541,836 | A | 9/1985 | Derderian | 44/53 |
| 4,599,088 | A | 7/1986 | Sung et al. | |
| 2001/0003881 | A1 | 6/2001 | Ahmed | 44/302 |

FOREIGN PATENT DOCUMENTS

| | | |
|---|---|---|
| EP | 0117328 | 9/1984 |
| GB | 5872763 | 4/1947 |

*Primary Examiner*—Walter D Griffin
*Assistant Examiner*—Frank C Campanell
(74) *Attorney, Agent, or Firm*—Allen, Dyer, Doppelt, Milbrath & Gilchrist, P.A.

(57) ABSTRACT

The present invention provides a fuel additive composition for stabilizing blends of ethanol and a hydrocarbon boiling in the gasoline or diesel range, comprising: a) 0.1-10% of Cashew Nut Shell Liquid (CNSL) derivative(s) or mixtures thereof of formula (I) where m=0-12, n=0, 2, 4 & 6 and b) 0.1-10% of an organic co-solvent depending upon the percentage composition of diesel and ethanol blend.

(I)

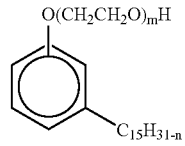

22 Claims, No Drawings

FUEL ADDITIVE COMPOSITION FOR STABILISING BLENDS OF ETHANOL AND A HYDROCARBON

FIELD OF THE INVENTION

This invention relates to a fuel additive composition for stabilising blends of ethanol and a hydrocarbon boiling in the gasoline and diesel range.

BACKGROUND OF THE INVENTION

Much research, efforts and time have been expended to produce fuel compositions for internal combustion engines which show significant decreases upon combustion of toxic exhaust gases or vapors, particulate, smoke, and the like without sacrifice of engine performance or efficiency. It is currently known by those skilled in the art that the introduction of oxygenates into fossil fuels contributes to better burning and the reduction of toxic exhaust emission. Ethanol is one such oxygenate which, when used with gasoline for instance, reduces toxic emissions.

A problem, however is that ethanol attracts water and will separate from gasoline in the presence of certain amounts of water condensation. Another problem is that ethanol is generally denatured using methanol, which exacerbates the problem of water separation and produces unacceptable solvency levels, such that ethanol/methanol/gasoline mixtures cannot be transported through existing pipelines. Another problem associated with using ethanol as an oxygenate is that ethanol, as well as methanol and other water-soluble alcohols, will not mix at all with less refined fossil fuels, such as diesel fuel or other distillate fuels like kerosene.

Conventional diesels, derived from crude petroleum, are used in a variety of applications, such as in transportation, power generation and the like.

Due to non-renewable nature of hydrocarbon fuels, considerable attention has been focused on development of alternate fuel sources. Oxygenated fuels containing ethanol or water have now been considered as the potential hybrid fuels and have gained the technical acceptance. The favourable economics of ethanol production and its increased availability combined with the beneficial effect on emissions has been the main factor behind development of ethanol-diesel blends. Thus, for the purpose of economics, combustion properties and renewal nature, ethanol is widely being used in hybrid diesel formulations which are also called 'oxydiesel'.

While 5-10% anhydrous ethanol is miscible in diesel at room temp (25° C.), trace amount of water or lower temperature cause immediate separation of the ethanol from the blends. Additionally, at lower temperatures, the ability of blend to tolerate moisture is much less and phase separation results. This separation of ethanol-water from the hydrocarbon body is undesirable as it could cause erratic combustion and severe corrosion in the fuel delivery system. Another major problem of making ethanol-diesel blends is of operational nature. This blend making process is energy intensive and it is very difficult to homogenise the blend.

Emulsion or micro emulsions containing hydrocarbon liquid in the continuous phase and alcohol or water in a dispersed phase have been described in a number of patents. These emulsions need a stabiliser which generally acts like an emulsifier.

A PCT application WO 9907465 by Apace research of Australia described an emulsifier, which is a block co-polymer of styrene or substituted styrene with ethylene oxide. Additionally, a coupler is also necessary which is chemically a block co-polymer of styrene or substituted styrene with other hydrocarbons like butadiene. EP patent 0089147 describes the use of block ethylene oxide-styrene copolymer for emulsifying alcohols in diesel fuel. Another PCT application WO 0031216 describes a ethanol solubilised diesel fuel composition.

PCT application WO 9935215 describes a additive composition also used as a fuel composition comprising water soluble alcohols. A German patent (DE 3525124, 1987) reported an emulsifier for making diesel-ethanol blends. The emulsifier was prepared by reaction of oleic acid with ethoxylated oleylamine.

U.S. Pat. Nos. 6,190,427 and 6,017,369 describe diesel fuel compositions stabilised by a mixture of fatty acid alcohols and a polymeric material. Another U.S. Pat. No. 4,451,265 describes diesel fuel-aqueous alcohol microemulsions based on a dimethylethanol amine surfactant system. A US patent (256206, 1981) describes a surfactant system containing N,N-dimethyl ethanol amine and long chain fatty acid.

Cashew nut shell liquid (CNSL) occurs as a reddish brown viscous liquid in the soft honeycomb structure of the shell of cashewnut, a plantation product obtained from the cashew tree, *Anacardium Occidentale* L. Native to Brazil, the tree grows in the coastal areas of Asia & Africa. Cashewnut attached to cashew apple is grey colored, kidney shaped and 2.54 cm long. The shell is about 0.3 cm thick, having a soft leathery outer skin and a thin hard inner skin. Between these skins is the honeycomb structure containing the phenolic material popularly called CNSL. Inside the shell is the kernel wrapped in a thin brown skin, known as the testa.

The nut thus consists of the kernel (20-25%), the shell liquid (20-25%) and the testa (2%), the rest being the shell. Natural CNSL, extracted with low boiling petroleum ether, contains about 90% anacardic acid and about 10% cardol. Natural CNSL, on distillation, gives the pale yellow phenolic derivatives, which are a mixture of biodegradable unsaturated m-alkenylphenols, including cardanol. Catalytic hydrogenation of these phenols gives a white waxy material, predominantly rich in tetrahydroanacardol.

CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL. U.S. Pat. No. 6,229,054 describes a process for hydroxyalkylation of cardanol with cyclic organic carbonates. CNSL derivatives have also been used for metal extraction, as exemplified in U.S. Pat. No. 4,697,038. In another U.S. Pat. No. 4,352,944, mannich bases of CNSL have been described.

However, the first application of CNSL in making lubricating oil additives was disclosed by us in U.S. Pat. Nos. 5,910,468 and 5,916,850. U.S. Pat. No. 6,339,052 also describes lubricant compositions for internal combustion engines based on additives derived from cashew nut shell liquid.

Ethoxylated alcohols have been used in past as a stabilising emulsifying additives for making stable ethanol-petroleum fuel compositions.

For example, a U.S. Pat. No. 6,080,716 of 2000 describes a surfactant which is made by reaction of aliphatic alcohol with ethylene oxide. The non-ionic ethoxylated surfactant, as stabilising additives are prepared from reaction of aliphatic alcohol with ethylene oxide and are also available commercially e.g., Neodol 91-2.5 from Shell chemicals. Thus, Neodols prepared from reaction of $C_9$ to $C_{11}$ alcohol with ethylene oxide to give products having average number of ethylene oxide from 2.5 to 10 per mole of alcohol (U.S. Pat. No. 6,183,524 of 2001) have been used as the stabilising additives.

OBJECTS AND SUMMARY OF THE INVENTION

The object of the invention is to obviate the above drawbacks by developing an additive composition which can be used to make stable fuel-alcohol mixtures.

Further, object of the invention is to propose an additive composition which is effective at lower dosage.

Still further objective is to minimize the cost of the coupler (additive composition) by selecting appropriate inexpensive raw materials.

Another object of the invention is to develop an emulsifier based on natural occurring biodegradable and abundantly available Cashew Nut Shell Liquid (CNSL) for preparing the additive composition.

To achieve said objectives this invention provides a fuel additive composition for stabilizing blends of ethanol and a hydrocarbon boiling in is the gasoline or diesel range, comprising:

a) 0.1-10% of Cashew Nut Shell Liquid (CNSL) derivative (s) or mixtures thereof of formula:

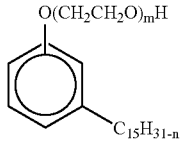

where m=0-12 n=0, 2, 4 & 6 and b) 0.1-10% of an organic co-solvent depending upon the percentage composition of diesel and ethanol blend In the above fuel additive composition, m=1-12 and n=2, 4, 6, and said CNSL derivatives are ethoxylates of CNSL.

In the above fuel additive composition m=1-12 and n=0, and said CNSL derivatives are ethoxylates of partially hydrogenated CNSL.

In the above fuel additive composition m=0 and n=0, and said CNSL derivative is partially hydrogenated CNSL.

In the above fuel additive composition m=0 and n=2, 4, 6, and said CNSL derivative is technical CNSL.

The said ethoxylated CNSL derivatives are reaction product of technical CNSL and an ethoxylating agent.

The said ethoxylated CNSL derivatives are reaction product of partially hydrogenated CNSL and an ethoxylating agent.

The said organic co-solvent is selected from the group of alcohol, fatty acid ester, ester and the mixture thereof.

The said organic co-solvent is a normal or branched chain primary or secondary alcohol having a carbon number of 3 to 16.

The said alcohol is present in an amount of 0.1-5 vol %.

The said fatty acid esters are methyl or ethyl esters of Jatropha carcus oil, soyabean oil, sunflower oil and karanjia oil.

The said ester is present in an amount 0.2% to 4% based upon the stabilizing additive composition.

The said mixture comprises CNSL and ethoxylated CNSL.

The said mixture comprises CNSL and hydrogenated CNSL.

The said mixture comprises ethoxylated CNSL and ethoxylated hydrogenated CNSL.

The said mixture comprises CNSL, hydrogenated CNSL and ethoxylated CNSL.

The blends of ethanol and hydrocarbon comprising ethanol 1-15% and diesel 85-99%.

The ethanol is having 0 to 1.0% by wt. of water and is referred to as anhydrous ethanol.

The ethanol containing higher than 1.0% water is referred to as hydrous ethanol.

The said fuel additive composition further includes cetane improver to meet the requirement as laid in the diesel fuel specification.

The said fuel additive composition further includes known corrosion inhibitors to control corrosion to the metallic parts on the fuel side components.

The present invention also provides a fuel composition comprising of (i) a hydrocarbon based fuel boiling in the gasoline or diesel range (ii) ethanol and (iii) fuel additive composition of the instant invention.

DETAILED DESCRIPTION OF THE INVENTION

The invention provides for a fuel stabilising additive mixture suitable for blending hydrocarbon fuel-alcohol mixtures. The invention describes a fuel additive useful for making stable hydrocarbon fuel alcohol blends for use in internal combustion engines. Ethanol-petroleum fuel blends directly address vehicle emissions, transport fuel security and supply issues. In addition to reducing currently regulated emissions, the renewable ethanol content of these fuels can result in net reduction in the emission of carbon dioxide. However, the amount of hydrous or anhydrous ethanol which can be added to petroleum fuels is very low as their miscibility is low and the layer of ethanol separates out. The problem of separation of ethanol from the ethanol-petroleum fuel blends become more aggravated specially at low temperatures. To make stable ethanol-petroleum fuel blends, addition of stabilising additives is necessary. The hybrid fuels prepared incorporating the additives mixture of the invention result in lower emissions and are stable over along period of storage, more than 6 months, at the temperatures equivalent to the pour point of the diesel.

The inventive stabilising additive consists of either cashew nut shell liquid (CNSL), technical or hydrogenated, or the ethoxylate of technical or hydrogenated CNSL, or the mixtures thereof.

It has been observed that ethoxylated CNSL is a very potent stabilising additive useful for making stable ethanol-petroleum hybrid fuel which are suitable as fuel in internal combustion engines. The natural or hydrogenated CNSL are ethoxylated using a known ethoxylating agent, such as ethylene oxide. The overall degree of ethoxylation of CNSL is varied by controlling the ratio of cashew nut shell liquid and ethylene oxide, the reaction temperature and pressure. Higher degree of ethoxylation results in better water solubilisation capacity which is desirable. However very high degree of ethoxylation leads to solidification of the product and therefore intermediate ethoxylation is desirable. It has been discovered in the present invention that CNSL having an ethoxylation content of 3 to 10 is most suitable for use as the stabilising additive for making ethanol-diesel blends. The ethoxylated CNSL of the present invention is far superior in stabilising efficacy vis-à-vis commercially available ethoxylated alcohols, e.g., Neodols. The higher efficacy of ethoxylated CNSL has resulted in its lower dosage and thus better cost-economics.

It has also been observed that technical CNSL as such or after hydrogenation is also a very potent coupling additive for making stable fuel-ethanol blends. The stabilising effect is further augmented, if a mixture of technical CNSL or hydrogenated CNSL and their ethoxylates are used. This capability of technical CNSL, hydrogenated CNSL and their ethoxylates to act as solubilising additive for making stable hydrocarbon fuel-ethanol blends has been observed for the first time. This observation is of particular importance as it will bring down the cost of stabilising coupler to a very significant level as the basic material, i.e., CNSL is of low cost and abundantly available. A high degree of biodegradability of CNSL and its ethoxylates is an additional desirable benefit.

The fuel compositions described in this invention contains ethanol. Ethanol is typically produced by fermentation of sugars derived from sugar residue, grains or from biomass. Ethanol suitable for use in accordance with the invention preferably includes fuel grade ethanol derived from yeast or bacterial fermentation of six carbon sugars extracted from corn, sugarcane or sugar beet. Fuel grade ethanol may be produced from lingocellulosic material, rice husks, bagasse etc by acid/base or enzymatic hydrolysis.

The suitable fuel grade ethanol in accordance with the present invention may be having up to 1.0% w/w water and this ethanol is referred as anhydrous ethanol. Alternatively, other type of ethanol, suitable for use in this invention may contain higher amount of water, i.e., more than 1.0% w/w and is referred as hydrous ethanol.

The miscibility of ethanol in diesel fuel is limited primarily because of differences in the polarity. The polarity of diesel is a function of its molecular composition and its electro chemical properties. The molecular composition of diesel depends upon the type of distillate streams it contains, the refining process and more importantly on the crude source.

Therefore, the inherent capability of any given diesel to solubilise ethanol is fixed. Diesel contains different hydrocarbon group types e.g paraffins, isoparrafins, naphthenes, olefins, aromatics and heterocyclics. Each of these groups have different polarity (dieletric constants). Aromatics, olefins and heterocyclics have higher polarities than paraffins, isoparraffins and naphthenes. The components with higher dielectric constant (e.g. aromatics) can easily have dipole-dipole interaction, with polar ethanol. This results in solubilisation of ethanol in diesel. The diesel with higher amount of aromatics can solubilise higher amount of ethanol. For this reason, diesel fractions obtained from hydrocracker and having lower aromatics, are very poor in solubilising ethanol. In the presence of water, the solubilising power of a given diesel is further depressed. This is explained by the higher polarity of water as compared to ethanol and its preferential dipole interaction with the polar components of diesel.

The overall ability of a given diesel to solubilise ethanol can be manipulated with the help of addition of external additives called couplers. These couplers are believed to act in two different ways. Firstly, these could act like a surfactant to bring in polar water and ethanol molecules into the hydrocarbon phase of diesel. These couplers are so designed that they have a moderately polar end and a non-polar tail. The polar head gets dissolved in the water or ethanol by H-bonding and the non-polar tail gets solubilised in the hydrocarbon phase (diesel).

The chemical couplers act as a bridge between polar water/ethanol and non-polar hydrocarbon phase. Thus chemically couplers like alcohol ethoxylates, functionalised polymers, long chain alcohols which contain polar head and non-polar chains are useful and have been used in the prior art.

The other method of solubilising ethanol in diesel is by the use of organic co-solvents. These are chemical compounds which have intermediate polarity between low polar diesel and higher polarity ethanol. These are used to increase the overall polarity of diesel so that it could solubilise higher amount of ethanol. Such co-solvents are selected from $C_4$-$C_8$ alcohols, $C_{10}$-$C_{20}$ esters etc.

If there is no water present in the diesel fuel/ethanol mixture, i.e., the ethanol used is anhydrous, then the solubilising power of the diesel is higher. However, when water even in trace amount is present in the mixture, then the available dipole-dipole interaction is preferred between water and polar components of diesel, instead of ethanol. Thus, the presence of water in the diesel fuel/ethanol mixture reduces the solubilisation of ethanol in diesel. The presence of water and its effect on the mixture is exacerbated with the lower temperature of mixture, especially below 4° C. Because water, unlike any fuel component, can exist in distinctly different physical form at or near its freezing point. therefore, at lower temperatures the solubilisation of water/ethanol in diesel is difficult and opaque solutions are obtained.

The organic co-solvent used in the present invention is generally selected from the polar compounds like alcohols, ethers or fatty acid esters. The main function of co-solvent is to enhance the overall polarity of fuel so that ethanol and water are drawn into the system. Once ethanol and water are in the system, then the stabilising additive solubilizes these with its surfactant action. Normal or branced alcohol having chain length of $C_3$ to $C_{10}$ are suitable. The most suitable alcohol may be $C_4$ alcohol which is effective in lower dosage.

Organic esters of lower acids and fatty acid esters can also be used as co-solvents. However, though lower esters e.g. ethyl acetate are potent co-solvent but their lower flash points are limiting factor for their use in diesel fuel. Fatty acid esters derived from the base or acid catalysed transestrification of natural oils have been found to be excellent co-solvent. Apart from providing the necessary solvation power, these esters also improve the overall lubricity of the diesel fuel, specially for fuels having very low level of sulphur (<200 ppm).

The fatty acid ethyl and methyl ester prepared from natural oils like Jatropha curcas, Karanjia, Sunflower and Soya oils were found to be suitable as co-solvent for making ethanol-diesel blends. The amount of these esters to be used in a blend depends upon the amount and water level of ethanol to be blended. However, the effective range of these fatty acid ester was 0.5-1.0% vol to 200-300 vol. of fuel.

Cetane index is the measure of combustability of diesel fuel in the internal combustion engine. The value of cetane number is generally specified in the commercial specification of fuel and are different for different countries. In India e.g the minimum cetane number is 48.

The ethanol-diesel blends generally fall short in the cetane number as the ethanol does not contribute to the overall cetane of the hybrid fuel. However, the cetane number of blended fuel can easily be boosted by adding small amount of cetane booster.

Organo nitrates e.g isopropyl nitrate or 2-ethyl hexyl nitrates which are available commercially are suitable to enhance the cetane of the ethanol blended hydrocarbon fuel. The amount of cetane booster present in the blend is the function of cetane value of the particular diesel fuel and the amount of ethanol present in the particular fuel composition. Generally, lower the diesel fuel cetane value, higher the amount of the cetane booster. Similarly, because ethanol typically acts as a cetane depressent, the higher the concentration of ethanol in the hybrid fuel, more is the concentration of cetane booster.

Higher amount of dissolved water in the ethanol-diesel fuel may cause corrosion to the metallic parts specially on the fuel side components. This problem could be easily controlled by addition of corrosion inhibitors. Several classes of corrosion inhibitors are known for use in fuels. However, it has been found that mercapto thiadiazole derivatives as described in U.S. Pat. No. 6,362,137 were the most effective in these fuels. For hydrocarbon fuels, containing 5-10% of ethanol, an addition of 0.001 to 0.01% volume of the mercapto thiadiazole described in U.S. Pat. No. 6,362,137 are sufficient to provide necessary anti corrosion properties.

The amount of CNSL, hydrogenated CNSL or ethoxylated CNSL to be used with a particular fuel depends upon the desired end specifications of the fuel the quality of ethanol and the amount of the ethanol to be blended. For example, if anhydrous ethanol is to be blended in diesel then the amount of ethoxylated CNSL will be lower than if the ethanol was hydrous. Due to various characteristics of hydrocarbon fuels, it is difficult to provide a singular relationship to the amount of CNSL or ethoxylated CNSL to be used. However, as a rough guide, to make 5-10% anhydrous ethanoldiesel blend which is stable up to −3° C., the volume ratio of additives to the fuel may be 1-2:100. The volume ratio for hydrous ethanol of the similar quantity may be 3-5:100.

The fuel composition of the invention provide a number of benefits. For example, the fuel composition remain stable over the range of temperatures (from the pour point of diesel to about +50° C.) which covers both summer and winter conditions. Additionally, the fuel composition remains clear and transparent even in the presence of water contamination of about 0.5-1.2% vol. The fuel also meets the minimum cetane number requirement as laid in the diesel fuel specification and the fuel blends can be prepared within minutes without the need of expensive and energy intensive fuel blending equipment. Since the blended fuel has lower sulphur and aromatics as compared to the parent diesel, the tail pipe sulphur emissions are low.

In order to evaluate the efficacy of the coupler or co-solvent to solubilise ethanol in diesel, an experiment was specifically designed. In this set-up, to a fixed volume of diesel, different amounts of couplers/co-solvents were added. To the mixture thus obtained, ethanol was gradually added with a burette, with continuous shaking. Appearance of turbidity or layer separation was noticed in each experiment. Higher the amount of ethanol, which could be added without causing turbidity or layer separation, reflected the higher solubilising power of the coupler/co-solvent. The results are presented in Table-1.

As is evident from Table-1, CNSL as such and its ethoxylated compounds show much enhanced power to solubilise ethanol in diesel. Thus, while 0.5% v/v of ethoxylated CNSL could solubilise 14-16% v/v of ethanol is diesel, whereas the commercially available ethoxylated alcohols, like Neodol 91-2.5 or Tomoh 11-3 could solubilise only approximately 10.0% v/v of ethanol in diesel. Other commercial surfactants were even poor in their solubilising power (6-8% v/v). The higher solubilising power of CNSL, hydrogenated CNSL and ethoxylated CNSL which contains both polar group (hydroxyl and aromatic ring) and a non-polar $C_{15}$ alkyl chain at meta position. The effect of both coupler and co-solvent on the solubilising power was also examined by these experiments. It was seen that a combination of CNSL/hydrogenated CNSL/ethoxylated CNSL and the co-solvent was more potent than the mixture of any other surfactant with the same co-solvent. Thus, while a mixture of 0.5% ethoxylated CNSL and 1% isobutanol could solubilise 19.4% v/v of ethanol in a given diesel, a mixture of other commercial ethoxylated alcohols with 1% isobutanol could only solubilise approximately 8-12% of ethanol.

TABLE 1

Ethanol Solubilisation in Diesel in the presence of Co-Solvent

| | | Surfactant Volume Used | | | | |
|---|---|---|---|---|---|---|
| | Surfactant | 0.2 | 0.4 | 0.6 | 0.8 | 1.0 |
| | | Alcohol Volume Solubilised | | | | |
| 1. | CNSL | 5.8 | 7.0 | 9.0 | 9.9 | 11.2 |
| 2. | Partially Hydrogenated CNSL | 5.5 | 6.5 | 7.8 | 9.8 | 11.0 |
| 3. | CNSL + Partially Hydrogenated CNSL (1:1) | 5.7 | 6.8 | 8.2 | 10.0 | 11.3 |
| 4. | Iso Butanol | 3.6 | 4.4 | 5.0 | 5.4 | 5.8 |
| 5. | Tert-Butanol | 3.5 | 4.3 | 5.0 | 5.5 | 6.1 |
| 6. | Decyl Alcohol-6 Ethoxylate | 2.5 | 2.3 | 1.4 | 1.8 | 1.9 |
| 7. | Tri-decyl Alcohol-6 Ethoxylate | 3.5 | 3.2 | 3.6 | 3.8 | 3.9 |
| 8. | Decyl Alcohol-6 Ethoxylate | 2.5 | 1.0 | 0.7 | 0.6 | 0.4 |
| 9. | Dioctyl phthalate | 3.45 | 3.45 | 3.5 | 3.5 | 4.3 |
| 10. | Dioctyl trimellitate | 3.1 | 3.2 | 3.2 | 3.2 | 3.5 |
| 11. | Methyl Ester of Rice Bran Oil Fatty Acids | 3.1 | 3.3 | 3.3 | 3.6 | 4.0 |
| 12. | Methyl Ester of Castor Oil Fatty Acids | 3.2 | 3.4 | 3.6 | 4.2 | 4.4 |
| 13. | Ethyl ester of castor oil fatty acids | 3.8 | 4.3 | 5.5 | 6.3 | 7.0 |
| 14. | NEODOL 91-2.5 Ethoxylate | 4.2 | 4.4 | 4.6 | 4.8 | 4.9 |
| 15. | TOMOH 91-2.5 | 4.2 | 4.4 | 4.7 | 4.7 | 4.9 |
| 16. | TOMOH 1-3 | 4.1 | 4.2 | 4.4 | 4.6 | 4.6 |
| 17. | TOMOH 25-3 | 4.3 | 4.2 | 4.2 | 4.4 | 4.4 |
| 18. | TOMOH 23-3 | 4.4 | 4.2 | 4.3 | 4.5 | 4.7 |
| 19. | CSNL Ethoxylate - 3 | 6.2 | 7.1 | 9.3 | 10.1 | 11.4 |
| 20. | CNSL Ethoxylate - 8 | 5.9 | 6.9 | 9.6 | 9.9 | 11.3 |
| 21. | CNSL + CNSL ethoxylate - 3 (1:1) | 6.3 | 7.0 | 9.5 | 10.0 | 11.5 |
| 22. | CNSL + partially hydrogenated CNSL + CNSL ethoxylate - 3 (1:1:1) | 5.9 | 6.5 | 9.2 | 9.9 | 11.6 |

** In all these experiments, 40 ml of diesel was taken. Without any Coupler/Co-Solvent, Diesel could solubilise only 2.2 ml of anthydrous ethanol. In the presence of 0.25% of co-solvent (tert-butanol), 40 ml of diesel could solubilise 2.9 ml of anhydrous ethanol.

Thus CNSL as such, after hydrogenation or preferably ethoxylated CNSL either alone or in combination with co-solvents offer a potent coupler for enhanced solubilisation of ethanol in diesel to give stable mixtures.

EXAMPLES

The following examples are provided to further illustrate the invention, but are not intended to limit the scope of the invention. Specifically, the following examples are provided to illustrate the composition, manufacture and physical characteristics of the inventive fuel composition containing ethanol and the inventive additives, which fully meet the laid down physico-chemical specifications of the diesel fuel.

Example 1

Hydrocarbon fuel (900 ml) is placed in a 1 litre flask at ambient temperature and pressure. Ethanol (80 ml) is added to the flask creating an oil phase and an alcohol phase. A mixture of isobutanol (10 ml) and ethoxylated cashew nut shell liquid (10 ml) is then added, a stopper is applied to the top of the flask and the resultant mixture is shaken for about one minute, to allow proper mixing of the liquids to take place and a single phase to form. The hybrid fuel as obtained is stable at −3° C. for more than three months.

Example 2

Cashew nut shell liquid (12 ml) is added to n-butanol (8 ml) and ethyl acetate (5 ml) with minimal stirring to form one phase. This is added to a two phase mixture of hydrocarbon fuel (900 ml) and ethanol (75 ml). The final blend is shaken for about one minute to form a single phase. The hybrid fuel as obtained is stable at −3° C. for more than three months.

Example 3

Hydrogenated cashew nut shell liquid (15 ml) and hydrocarbon fuel (885 ml) are mixed together and ethanol (100 ml) is added slowly to this mixture. After completion of the addition of ethanol, the oxy diesel blend is shaken for about one minute, till a single phase is formed. The hybrid fuel so obtained is stable over a long period without any separation of layers.

Example 4

Ethoxylate of distilled technical Cashew nut shell liquid (10 ml) and ethanol (100 ml) are mixed together and hydrocarbon fuel (890 ml) is added slowly to this mixture. After completion of the addition of ethanol, the oxy diesel blend is shaken for about one minute, till a single phase is formed.

By adopting any of the above blending procedures, the following stable compositions can be obtained. Product blends were made (as percentage v/v) as follows.

Composition 1:
Diesel: 85.0%
Ethanol: 10.0%
Cashew Nut Shell Liquid (CNSL): 1.0%
Bio-Diesel: 4.0%

Composition 2:
Diesel: 86.0%
Ethanol: 12.0%
Cashew Nut Shell Liquid (CNSL): 1.0%
CNSL Ethoxylate with 3 ethylene oxide moieties: 1.0%

Composition 3:
Diesel: 85.0%
Ethanol: 12.0%
Cashew Nut Shell Liquid (CNSL): 0.75%
CNSL Ethoxylate with 5 ethylene oxide moieties: 0.75%
Bio-Diesel: 1.5%

Composition 4:
Diesel: 92.0%
Ethanol: 6.0%
Cashew Nut Shell Liquid (CNSL): 1.0%
Bio-Diesel: 1.0%

Composition 5:
Diesel: 85.0%
Ethanol: 10.0%
Cashew Nut Shell Liquid (CNSL): 1.5%
Bio-Diesel: 2.5%
n-Butanol: 1.0%

Composition 6:

Composition 6:
Diesel: 92.0%
Ethanol: 6.0%
Cashew Nut Shell Liquid (CNSL): 1.2%
Ethyl Acetate: 0.8%

Composition 7:
Diesel: 85.0%
Ethanol: 10.0%
Cashew Nut Shell Liquid (CNSL): 2.0%
CNSL Ethoxylate with 8 ethylene oxide moieties: 3.0%

Composition 8:
Diesel: 85.0%
Ethanol: 10.0%
Partially hydrogenated Cashew Nut Shell Liquid (CNSL): 1.0%
Bio-Diesel: 4.0%

Composition 9:
Diesel: 80.0%
Ethanol: 15.0%
Cashew Nut Shell Liquid (CNSL): 2.0%
Bio-Diesel: 2.0%
CNSL Ethoxylate with 5 ethylene oxide moieties: 1.0%

Composition 10:
Diesel: 84.0%
Ethanol: 12.0%
Cashew Nut Shell Liquid (CNSL): 1.5%
Partially Cashew Nut Shell Liquid: 0.5%
CNSL Ethoxylate having 3 ethylene oxide moieties: 2.5%

Composition 11:
Gasoline: 85.0%
Ethanol: 11.0%
Cashew Nut Shell Liquid (CNSL): 1.0%
Bio-Diesel: 3.0%

Composition 12:
Gasoline: 90.0%
Ethanol: 8.0%
Cashew Nut Shell Liquid (CNSL): 1.0%
CNSL Ethoxylate with 3 ethylene oxide moieties: 1.0%

Composition 13:
Gasoline: 85.0%
Ethanol: 12.0%
Cashew Nut Shell Liquid (CNSL): 0.75%
CNSL Ethoxylate with 5 ethylene oxide moieties: 0.75%
Bio-Diesel: 1.5%

Composition 14:
Gasoline: 90.0%
Ethanol: 8.0%
Cashew Nut Shell Liquid (CNSL): 0.5%
CNSL Ethoxylate with 5 ethylene oxide moieties: 0.5%
Bio-Diesel: 1.0%

Composition 15:
Gasoline: 92.0%
Ethanol: 7.5%
Cashew Nut Shell Liquid (CNSL): 0.25%
Tert-Butanol: 0.25%

All of the above compositions had a single phase demonstrating the effectiveness of the use of Cashew nut shell liquid and Cashew Nut Shell Liquid Ethoxylates to blend hydrocarbon fuels with ethanol. These compositions were tested at varying temperatures from −5° C., 0° C., 10° C., 15° C., 20° C., 25° C. & 30° C., which reflect typical operating temperatures for normal transport fuels and were not found to be temperature sensitive. In each of the compositions listed above, the blend of the diesel oil and ethanol is in one phase and the blend was found to operate satisfactorily as a fuel.

In addition to above primary components, cetane improver, lubricity additive and corrosion inhibitor were added as per operational requirements. The addition of these components did not affect the stability of the diesel-ethanol-CNSL blends at varying temperatures.

We claim:

1. A fuel additive composition for stabilizing blends of ethanol and a hydrocarbon boiling in the gasoline or diesel range, comprising:

a) 0.1-10% of Cashew Nut Shell Liquid (CNSL) derivative (s) or mixtures thereof of formula:

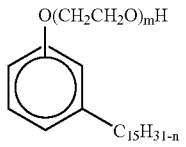

where m=1-12 n=0, 2, 4 & 6 and b) 0.1-10% of an organic co-solvent depending upon the percentage composition of diesel and ethanol blend.

2. A fuel additive composition as claimed in claim 1, wherein m=1-12 and n=2, 4, 6, and said CNSL derivatives are ethoxylates of CNSL.

3. A fuel additive composition as claimed in claim 1, wherein m=1-12 and n=0, and said CNSL derivatives are ethoxylates of partially hydrogenated CNSL.

4. A fuel additive composition as claimed in claim 1, wherein m=1 and n=0, and said CNSL derivative is partially hydrogenated CNSL.

5. A fuel additive composition as claimed in claim 1, wherein m=1 and n=2, 4, 6, and said CNSL derivative is technical CNSL.

6. A fuel additive composition as claimed in claim 2, wherein said ethoxylated CNSL derivatives are reaction product of technical CNSL and an ethoxylating agent.

7. A fuel additive composition as claimed in claim 3, wherein said ethoxylated CNSL derivatives are reaction product of partially hydrogenated CNSL and an ethoxylating agent.

8. A fuel additive composition as claimed in claim 1 wherein said organic co-solvent is selected from the group of alcohol, fatty acid ester, ester and the mixture thereof.

9. A fuel additive composition as claimed in claim 1, wherein said organic co-solvent is a normal or branched chain primary or secondary alcohol having a carbon number of 3 to 16.

10. A fuel additive composition as claimed in claim 9, wherein said alcohol is present in an amount of 0.1-5 vol %.

11. A fuel additive composition as claimed in claim 8, wherein said fatty acid esters are methyl or ethyl esters of Jatropha carcus oil, soyabean oil, sunflower oil and karanjia oil.

12. A fuel additive composition as claimed in claim 8, wherein said ester is present in an amount 0.2% to 4% based upon the stabilizing additive composition.

13. A fuel additive composition as claimed in claim 1, wherein said mixture comprises CNSL and ethoxylated CNSL.

14. A fuel additive composition as claimed in claim 1, wherein said mixture comprises CNSL and hydrogenated CNSL.

15. A fuel additive composition as claimed in claim 1, wherein said mixture comprises ethoxylated CNSL and ethoxylated hydrogenated CNSL.

16. A fuel additive composition as claimed in claim 1, wherein said mixture comprises CNSL, hydrogenated CNSL and ethoxylated CNSL.

17. A fuel additive composition as claimed in claim 1, wherein blends of ethanol and hydrocarbon comprising ethanol 1-15% and diesel 85-99%.

18. A fuel additive composition as claimed in claim 17, wherein ethanol is having 0 to 1.0% by wt. of water and is referred to anhydrous ethanol.

19. A fuel additive composition as claimed in claim 17, wherein ethanol contains higher than 1.0% water by wt. and is referred as hydrous ethanol.

20. A fuel additive composition as claimed in claim 1, further includes cetane improver to meet the requirement as laid in the diesel fuel specification.

21. A fuel additive composition as claimed in claim 1, further includes known corrosion inhibitors to control corrosion to the metallic parts on the fuel side components.

22. A fuel composition comprising of (i) a hydrocarbon based fuel boiling in the gasoline or diesel range (ii) ethanol and (iii) fuel additive composition of claim 1.

* * * * *